US005154838A

United States Patent [19]

Yamamura et al.

[11] Patent Number: 5,154,838

[45] Date of Patent: Oct. 13, 1992

[54] LIQUID SOFTENER

[75] Inventors: Masaaki Yamamura; Junichi Inokoshi; Kazutaka Shiratsuchi, all of Tochigi, Japan

[73] Assignee: Kao Corporation, Tokyo, Japan

[21] Appl. No.: 697,416

[22] Filed: May 9, 1991

[30] Foreign Application Priority Data

Jun. 1, 1990 [JP] Japan ..... 2-143505

[51] Int. Cl.[5] ..... D06M 10/08

[52] U.S. Cl. ..... 252/8.6; 252/8.7; 252/8.75; 252/88; 252/89

[58] Field of Search ..... 252/8.6, 8.7, 8.75, 252/8.8 R, 8.9

[56] References Cited

U.S. PATENT DOCUMENTS

| | | | |
|---|---|---|---|
| 4,022,938 | 5/1977 | Zaki et al. | 252/8.8 |
| 4,110,498 | 8/1978 | Benjamin et al. | 252/8.8 |
| 4,136,054 | 1/1979 | Petzold et al. | 252/8.8 |
| 4,360,437 | 11/1982 | Wolfes | 252/8.8 |
| 4,367,151 | 1/1983 | Kinsman et al. | 252/8.8 |
| 4,370,272 | 1/1983 | Wechsler | 252/8.8 |
| 4,399,044 | 8/1983 | Richmond | 252/8.8 |
| 4,486,195 | 12/1984 | Weinstein et al. | 252/8.8 |
| 4,767,548 | 8/1988 | Kasprzak et al. | 252/8.8 |
| 4,931,216 | 6/1990 | Igarashi et al. | 252/8.8 |
| 4,975,091 | 12/1990 | Becker et al. | 252/8.8 |

FOREIGN PATENT DOCUMENTS 0199382 10/1986 European Pat. Off. .

OTHER PUBLICATIONS

European Search Report.

*Primary Examiner*—A. Lionel Clingman
*Assistant Examiner*—William S. Parks
*Attorney, Agent, or Firm*—Birch, Stewart, Kolasch & Birch

[57] ABSTRACT

A liquid softener composition comprises water and an amidoamine compound (a) obtained by condensation reaction of a di- or triamine of the general formula (I) with a fatty acid of the general formula (II), or a neutral salt of the amidoamine compound with an inorganic or organic acid:

$$R^1NH(C_mH_{2m}NH)_nH \quad (I)$$

$$R^2-\overset{\overset{O}{|}}{C}-OH \quad (II)$$

wherein $R^1$ represents a straight chain or branched, saturated or unsaturated hydrocarbon group having 8 to 24 carbon atoms, $R^2$ represents a straight chain or branched, saturated or unsaturated hydrocarbon group having 7 to 23 carbon atoms, m represents 2 or 3, and n represents 1 or 2.

11 Claims, No Drawings

LIQUID SOFTENER

FIELD OF INDUSTRIAL APPLICATION

The present invention relates to a liquid softener. In particular, the present invention relates to a household liquid softener capable of imparting excellent softness to fibers and having high dispersibility in rinse water.

PRIOR ART

Most household softeners now available on the market comprise a composition containing, as the active ingredient, a quaternary ammonium salt having two long chain alkyl groups in the molecule such as a di(-hardened tallow alkyl)dimethylammonium chloride, since even a small amount of this quaternary ammonium salt exhibits excellent softening effect on fibers.

The softeners mainly comprising the above-described quaternary ammonium salt is put on the market and practically used in the form of a 4 to 20% dispersion.

When a stirring power is insufficient, the quaternary ammonium salt added to rinse water cannot be thoroughly dispersed in water, since it has strong hydrophobic properties. As a result, it might unevenly attach to the clothes. Although commercially available softeners contain various additives in addition to the quaternary ammonium salt in order to improve the dispersibility thereof in water, the effects thereof are yet insufficient.

Liquid softeners comprising an amine as the active ingredient have been known. For example, Japanese Patent Laid-Open No. 59796/1977 discloses a composition for imparting softness to fibers which comprises a long-chain alkylamine such as methyldi(hardened tallow alkyl)amine; Japanese Patent Laid Open No. 60700/1983 discloses a finishing agent for fibrous materials which comprises an acylated alkanolamine, a water-soluble quaternary ammonium salt and a fatty acid ester and which is capable of imparting smoothness and a pleasant touch to the fibers; Japanese Patent Laid Open No. 167083/1986 discloses a softener having high dispersibility which comprises a quaternary ammonium compound, a condensation reaction product of a higher fatty acid with a hydroxy-lower alkylpolyamine and an alkylamine polyglycol ether; Japanese Patent Laid-Open No. 275474/1986 discloses a stable aqueous dispersion for treating fabrics which comprises a di(higher alkyl) cyclic amine and a Bronstead acid; Japanese Patent Laid Open No. 85368/1989 discloses a softening composition comprising a di-long-chain alkylamine/anionic surfactant ion pair complex, a non-silicone wax and a liquid carrier; Japanese Patent Laid Open No. 6662/1990 discloses a composition for conditioning a cloth which comprises an amine such as a condensate of a hydroxy-lower alkylalkylenediamine with a higher fatty acid and an amphoteric conditioning agent for cloths; and Japanese Patent Laid-Open No. 14076/1990 discloses a composition for conditioning cloths which comprises a di-long chain alkylamine/polyfunctional carboxylic acid complex and which is capable of imparting softness and antistatic properties to the cloths.

In addition, Japanese Patent Laid Open No. 5394/1977 discloses a composition for conditioning cloths which comprises a mono- or di-long-chain alkylalkylenediamine antistatic agent and a quaternary ammonium softener.

However, the effects of the softeners containing such an amine are yet insufficient.

SUMMARY OF THE INVENTION

After intensive investigations on the softeners containing an amine, the inventors have found that specified amidoamine compound or neutralization products of them have an excellent softening effect and quite high dispersibility in rinse water. The present invention has been completed on the basis of this finding.

The present invention provides a liquid softener characterized by comprising the following component (a) as the essential ingredient:

(a) an amidoamine compound formed by the condensation reaction of a di- or triamine of the general formula (I) with a fatty acid of the general formula (II), or a neutral salt of the amidoamine compound with an inorganic or organic acid:

$$R^1NH(C_mH_{2m}NH)_nH \quad (I)$$

$$R^2-\overset{\overset{\displaystyle O}{\|}}{C}-OH \quad (II)$$

wherein $R^1$ represents a straight chain or branched, saturated or unsaturated hydrocarbon group having 8 to 24 carbon atoms, $R^2$ represents a straight chain or branched, saturated or unsaturated hydrocarbon group having 7 to 23 carbon atoms, m represents 2 or 3, preferably 3, and n represents 1 or 2, preferably 1.

The liquid softener composition of the invention comprises water and the amidoamine compound (a).

The amidoamine compound used in the present invention is produced by the condensation reaction of 1 mol of a diamine or triamine (I) with 1 to 3 mol, preferably 1 mol, of a fatty acid (II). The fatty acids to be subjected to this reaction usually include those derived from natural oils and fats such as coconut oil, palm oil, tallow, rape oil and fish oil and further chemically synthesized fatty acids are also usable.

At least one of R1 and R2 in the formulae (I) and (II) is preferred to have at least 15 or 16 carbon atoms.

More desirable results are obtained when the amidoamine compound is used in the form of its neutral salt. Compounds neutralized with a neutralizing agent such as an inorganic acid, e.g. hydrochloric or sulfuric acid, or an organic acid, e.g. acetic, glycolic, lactic, citric, maleic, fumaric or toluenesulfonic acid are used.

The component (a) is incorporated into the composition in an amount of 1 to 30% by weight, preferably 4 to 30% by weight and particularly preferably 10 to 25% by weight.

The composition of the present invention can be prepared by, for example, slowly adding a molten or concentrated amidoamine compound to an aqueous solution containing or not containing the neutralizing agent under stirring or shear mixing. The process for preparing the composition is not limited to this, and another process wherein the neutral salt is previously prepared or the neutralizing agent is added afterward can also be employed.

It is desirable that 0.3 to 20% by weight, preferably 0.6 to 10% by weight and particularly preferably 0.6 to 5% by weight, based on the component (a), of an inorganic electrolyte is added thereto in order to reduce the viscosity and to further improve the dispersibility in the preparation of the composition. Examples of the inorganic electrolytes include sodium chloride, sodium bromide, calcium chloride and magnesium chloride.

To obtain dispersibility in water and the preferred softening effect, the average particle diameter of component (a) is desirably in the range of 0.1 to 5 μm. The most suitable method of adjusting the average particle diameter in this range comprises controlling the stirring shear force depending on the kind and amount of the component (a) during the preparation. When the average particle diameter of the component (a) is less than 0.1 μm, the softness will be insufficient and, on the contrary, when it is larger than 5 μm, the dispersibility in water will be reduced.

Quaternary ammonium salts usually used, such as those shown below, can be incorporated into the liquid softener of the present invention:

(III)

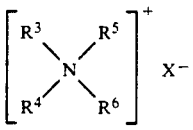

(IV)

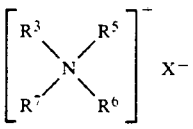

(V)

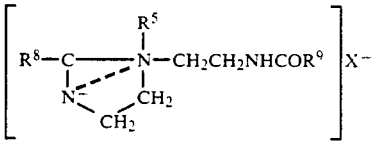

(VI)

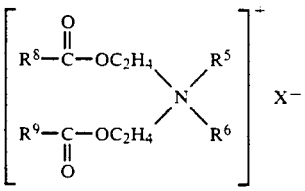

(VII)

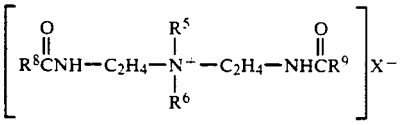

wherein $R^3$, $R^4$, $R^8$ and $R^9$ each represent an alkyl, alkenyl or β-droxyalkyl group having 10 to 24 carbon atoms, $R^5$, $R^6$ and $R^7$ each represent an alkyl or hydroxyalkyl group having 1 to 3 carbon atoms, benzyl group or $-(C_2H_4O)_q-H$ (q being 1 to 3) and X is a monoalkyl sulfate in which the alkyl has 1 to 3 carbon atoms or a halogen.

Examples of the compounds of the general formula (III) include di(tallow)dimethylammonium chloride, di(tallow)dimethylammonium methylsulfate, di(hydrogenated tallow)dimethylammonium chloride, distearyldimethylammonium chloride, dibehenyldimethylammonium chloride and dioleyldimethylammonium chloride.

Examples of the compounds of the general formula (IV) include mono(tallow)trimethylammonium chloride and mono(hydrogenated tallow)trimethylammonium chloride.

Examples of the compounds of the general formula (V) include 1-methyl-1-(tallow amidoethyl)-2-(tallow-)imidazolinium methylsulfate and 1-methyl-1-(hydrogenated tallow-amideethyl-2-hydrogenated tallow imidazolinium methyl sulfate.

Examples of the compounds of the general formula (VI) include methylbis(tallowyloxyethyl)(2-hydroxyethyl)ammonium chloride and methylbis(stearoyloxyethyl)(2-hydroxyethyl)ammonium methylsulfate.

Examples of the compounds of the general formula (VII) include methylbis(tallowamidoethyl)(2-hydroxyethyl)ammonium methylsulfate and methylbis(hydrogenated tallowamidoethyl)(2-hydroxyethyl)ammonium methylsulfate.

By using these quaternary ammonium salts, a resilience (fluffiness) can be imparted to the clothes in addition to the softness.

The liquid softener of the present invention may further contain a nonionic surfactant such as polyoxyethylene (5 to 50 mol) alkyl or alkenyl ($C_{12}$ to $C_{24}$) ether, a solvent such as ethanol, propylene glycol or ethylene glycol or urea for improving the storability; a silicone such as polydimethylsiloxane, polyether modified silicone or amino-modified silicone for improving water absorption; a pigment or dye for improving the appearance of the product; a fluorescent brightener for whitening the clothes; and a flavor for comforting the users after finishing or during the use thereof.

EXAMPLES

The following examples will further illustrate the present invention, which by no means limit the invention.

The following synthesis examples will illustrate the process for producing the neutralized amidoamine compounds used in the present invention.

SYNTHESIS EXAMPLES 484 g (2 mol) of N-laurylpropylenediamine was added to 568 g (2 mol) of stearic acid and the reaction was conducted at 70° to 190° C. for 3 h to distill off 35 g of water, thus giving the amidoamine compound.

The condensate was added to 210 g of a 35% aqueous hydrochloric acid solution to give Compound (a-1) of the present invention.

Compounds (a-2) to (a-5) of the present invention listed in Table 1 were produced in the same manner as above, that is, a reaction of 2 moles of the amine (I) and 2 moles of the aliphatic acid (II) and neutralization.

TABLE 1

| | Composition of component (a) | | |
|---|---|---|---|
| compound | Formula (I) | Formula (II) | Neutralizing agent |
| a-1 | $R^1$: $C_{12}H_{25}$ m: 3, n: 1 | $R^2$: $C_{17}H_{35}$ | hydrochloric acid |
| a-2 | $R^1$: $C_{18}H_{37}$ m: 3, n: 1 | $R^2$: $C_{17}H_{35}$ | hydrochloric acid |
| a-3 | $R^1$: hardened tallow alkyl m: 3, n: 1 | $R^2$: $C_{17}H_{35}$ | glycolic acid |
| a-4 | $R^1$: unhardened tallow alkyl m: 3, n: 1 | $R^2$: $C_{17}H_{33}$ | acetic acid |
| a-5 | $R^1$: unhardened tallow alkyl m: 3, n: 1 | $R^2$: $C_{17}H_{33}$ | hydrochloric acid |

EXAMPLES 1 TO 13 AND COMPARATIVE EXAMPLE 1

The softness and dispersibility in water of the compositions listed in Table 2 were evaluated by the following methods:

Evaluation of Softness (1) Treatment method:

2 kg of commercially available cotton towels and 1 kg of acrylic jersey were washed with a commercially available detergent ("Attack"; registered trade name of Kao Corporation) in 3.5° DH hard water five times (in a 30-l washing machine) to remove textile processing agents from them. They were treated with 10 ml of a 15% dispersion of a composition specified in Table 2 by stirring at 25° C. for 1 min.

(2) Evaluation method:

The cloths treated as described above were air-dried in a room and then left to stand in an air-conditioned room at 25° C. and 65% RH for 24 h.

The softness of these cloths was evaluated.

The softness was determined by paired comparison with a cloth treated with 10 ml of a softener comprising 15% by weight of a di(hydrogenated tallow alkyl)dimethylammonium chloride as the control. The results were classified into the following groups:

+2: the sample was softer than the control.
+1: the sample was slightly softer than the control.
0: the sample was as soft as the control.
−1: the control was slightly softer than the sample.
−2: the control was softer than the sample.

Evaluation of Dispersibility in Water

Water was placed to a depth of a high level in a fully automatic washing machine ("Shizuka-gozen for Bio 65"; trade name of Hitachi, Ltd.) and the machine was operated for 2 min while the dial was adjusted to "soft water stream". 5 sec after the completion of the operation, each composition listed in Table 2 was thrown thereinto and the dispersibility thereof was observed after 5, 10 and 30 sec. The results were classified into the following groups:

+2: homogeneously dispersed after 5 sec
+1: homogeneously dispersed after 10 sec
0: homogeneously dispersed after 30 sec
−1: partially heterogeneous after 30 sec
−2: not dispersed at all even after 30 sec.

It will be apparent from Table 2 that when the compound of the present invention is used, both of sufficient softness and dispersibility in water can be obtained.

TABLE 2

| | Softness and dispersibility in water | | | | | |
|---|---|---|---|---|---|---|
| | Component | Electrolyte | | Particle diameter*2 | Properties | |
| | (a) | kind | amount*1 | (μm) | softness | dispersibility in water |
| Ex. | | | | | | |
| 1 | a-1 | NaCl | 1.0 | 0.6 | +1 | +1 |
| 2 | a-1 | $CaCl_2$ | 0.6 | 0.5 | 0 | +1 |
| 3 | a-1 | $CaCl_2$ | 1.0 | 1.0 | +1 | +2 |
| 4 | a-1 | $CaCl_2$ | 3.0 | 1.1 | 0 | +2 |
| 5 | a-1 | $MaCl_2$ | 1.0 | 0.7 | +1 | +1 |
| 6 | a-2 | NaCl | 0.4 | 1.0 | 0 | +2 |
| | | $CaCl_2$ | 1.0 | | | |
| 7 | a-2 | $CaCl_2$ | 1.6 | 0.9 | 0 | +2 |
| 8 | a-2 | $CaCl_2$ | 2.4 | 1.0 | 0 | +2 |
| 9 | a-2 | $MgCl_2$ | 0.5 | 0.7 | 0 | +1 |
| 10 | a-3 | $CaCl_2$ | 0.8 | 0.7 | 0 | +2 |

TABLE 2-continued

| | Softness and dispersibility in water | | | | | |
|---|---|---|---|---|---|---|
| | Component | Electrolyte | | Particle diameter*2 | Properties | |
| | (a) | kind | amount*1 | (μm) | softness | dispersibility in water |
| 11 | a-3 | $CaCl_2$ | 1.4 | 1.2 | +1 | +1 |
| 12 | a-4 | $CaCl_2$ | 1.0 | 1.0 | 0 | +2 |
| 13 | a-5 | $CaCl_2$ | 1.0 | 1.3 | 0 | +2 |
| Comp. Ex. 1 | a-6*3 | $CaCl_2$ | 1.0 | 0.9 | 0 | −1 |

Notes
*1Amount of electrolyte: % by weight based on component (a)
*2Particle diameter: determined with a light-scattering photometer
*3a-6: di(hardened tallow alkyl)dimmethylammonium chloride The amount of the component (a) in the composition was 15% by weight.

EXAMPLE 14

The following composition was prepared and the softness and dispersibility in water thereof were determined in the same manners as those of Examples 1 to 13. The softness was +1 and the dispersibility in water was +2.

| Composition: | |
|---|---|
| a-1 | 12% by weight |
| di(hardened tallow)-dimethylammonium chloride | 3 |
| $CaCl_2$ | 0.15 |
| flavor | 0.3 |
| water | the balance |

The average diameter of the dispersed particle was 1.5 μm. The resilience of the towel treated with the above described composition was evaluated as follows:

Evaluation of Resilience

Three cotton towels treated in the same manner as that of Examples 1 to 13 were each folded in eight and piled up. A pressure of 5 g/cm$^2$ was applied to the pile for 5 min. Then the pressure was removed and the height of the pile was measured. The higher the pile, the higher the resilience.

The height of the pile of the towel treated with the above described composition was 9.6 cm and that treated with the composition of Comparative Example 1 was 8.8 cm.

We claim:

1. A liquid softener composition comprising water and an effective softening amount of an amidoamine compound (a) obtained by the condensation reaction of a di- or triamine of the general formula (I) with a fatty acid of the general formula (II), or a neutral salt of said amidoamine compound with an inorganic or organic acid:

$$R^1NH(C_mH_{2m}NH)_nH \quad (I)$$

$$R^2-\overset{\overset{\displaystyle O}{\|}}{C}-OH \quad (II)$$

wherein $R^1$ represents a straight chain or branched, saturated or unsaturated hydrocarbon group having 8 to 24 carbon atoms, $R^2$ represents a straight chain or branched, saturated or unsaturated hydrocarbon group having 7 to 23 carbon atoms, m represents 2 or 3, and n represents 1 or 2.

2. The composition as claimed in claim 1, which comprises 1 to 30 percent by weight of (a).

3. The composition as claimed in claim 1, which further comprises 0.3 to 20 percent by weight, based on (a), of an inorganic electrolyte.

4. The composition as claimed in claim 1, in which n is 1.

5. The composition as claimed in claim 1, in which (a) is the neutral salt.

6. The composition as claimed in claim 1, in which the inorganic electrolyte is selected from the group consisting of sodium chloride, sodium bromide, calcium chloride and magnesium chloride.

7. The composition as claimed in claim 1, in which (a) has an average size of 0.1 to 5 microns.

8. The composition as claimed in claim 1, which further comprises a quaternary ammonium salt.

9. The composition as claimed in claim 1, which further comprises a solvent, urea, a silicone compound, a coloring matter, a whitener or a perfume.

10. The composition according to claim 1, wherein at least one of R1 and R2 have at least 15 carbon atoms.

11. The composition according to claim 1, which further comprises a nonionic surfactant.

* * * * *